US009068478B2

(12) United States Patent
Roberts et al.

(10) Patent No.: US 9,068,478 B2
(45) Date of Patent: Jun. 30, 2015

(54) APPARATUS AND SYSTEM COMPRISING INTEGRATED MASTER-SLAVE PISTONS FOR ACTUATING ENGINE VALVES

(71) Applicant: Jacobs Vehicle Systems, Inc., Bloomfield, CT (US)

(72) Inventors: Gabriel Roberts, Wallingford, CT (US); Neil Fuchs, New Hartford, CT (US); Justin Baltrucki, Manchester, CT (US)

(73) Assignee: Jacobs Vehicle Systems, Inc., Bloomfield, CT (US)

( * ) Notice: Subject to any disclaimer, the term of this patent is extended or adjusted under 35 U.S.C. 154(b) by 0 days.

(21) Appl. No.: 14/188,867

(22) Filed: Feb. 25, 2014

(65) Prior Publication Data

US 2014/0238015 A1 Aug. 28, 2014

Related U.S. Application Data

(60) Provisional application No. 61/769,171, filed on Feb. 25, 2013.

(51) Int. Cl.
*F01L 1/18* (2006.01)
*F01L 1/26* (2006.01)
(Continued)

(52) U.S. Cl.
CPC .. *F01L 1/181* (2013.01); *F01L 1/08* (2013.01); *F01L 1/267* (2013.01); *F01L 13/0036* (2013.01); *F01L 13/06* (2013.01); *F01L 2001/186* (2013.01); *F01L 2105/00* (2013.01)

(58) Field of Classification Search
CPC ..... F01L 1/04; F01L 13/0036; F01L 1/267; F01L 2105/00; F01L 1/08; F01L 2001/186; F01L 13/06
USPC ..... 123/90.16, 90.39
See application file for complete search history.

(56) References Cited

U.S. PATENT DOCUMENTS 6,125,828 A * 10/2000 Hu ..... 123/568.14
6,244,257 B1 6/2001 Hu
(Continued)

FOREIGN PATENT DOCUMENTS

CN 202090976 U 12/2011
CN 102787880 A 11/2012
(Continued)

OTHER PUBLICATIONS

Search Report and Written Opinion issued in PCT/US14/18201 on Jun. 13, 2014.

*Primary Examiner* — Zelalem Eshete
(74) *Attorney, Agent, or Firm* — Vedder Price, P.C.

(57) ABSTRACT

An apparatus for actuating first and second engine valves comprises a rocker arm that receives motion from primary and auxiliary valve actuation motion sources at a motion receiving end of the rocker arm. A master piston residing in a master piston bore in the rocker arm is configured to received motion from the auxiliary valve actuation motion source. A slave piston residing in a slave piston bore in the rocker arm is configured to provide auxiliary valve actuation motion to the first engine valve. A hydraulic circuit is provided in the rocker arm connecting the master piston bore and the slave piston bore, and a check valve is disposed within the rocker arm, configured to supply hydraulic fluid to the hydraulic circuit. The apparatus may be incorporated into a system comprising a rocker arm shaft and the primary and secondary valve actuation motion sources, such as an internal combustion engine.

23 Claims, 9 Drawing Sheets

(51) Int. Cl.

| | |
|---|---|
| ***F01L 13/00*** | (2006.01) |
| *F01L 1/08* | (2006.01) |
| *F01L 13/06* | (2006.01) |

(56) References Cited

U.S. PATENT DOCUMENTS

| | | | | |
|---|---|---|---|---|
| 6,415,752 | B1 | 7/2002 | Janak | |
| 6,422,186 | B1 | 7/2002 | Vanderpoel | |
| 6,450,144 | B2 | 9/2002 | Janak et al. | |
| 6,691,674 | B2 | 2/2004 | McCarthy et al. | |
| 6,883,492 | B2 | 4/2005 | Vanderpoel et al. | |
| 6,904,892 | B1 | 6/2005 | Afjeh | |
| 6,920,868 | B2 | 7/2005 | Rugiero et al. | |
| 7,712,449 | B1 | 5/2010 | Schwoerer | |
| 8,151,763 | B2 | 4/2012 | Meistrick et al. | |
| 8,499,740 | B2 | 8/2013 | Yoon et al. | |
| 2005/0000499 | A1* | 1/2005 | Ruggiero et al. | 123/568.14 |
| 2011/0297123 | A1 | 12/2011 | Meistrick | |
| 2012/0298057 | A1 | 11/2012 | Janak et al. | |

FOREIGN PATENT DOCUMENTS

| | | | |
|---|---|---|---|
| CN | 202937322 | U | 5/2013 |
| EP | 2137386 | B1 | 9/2012 |
| WO | 9923363 | A1 | 5/1999 |
| WO | 9927243 | A2 | 6/1999 |

* cited by examiner

APPARATUS AND SYSTEM COMPRISING INTEGRATED MASTER-SLAVE PISTONS FOR ACTUATING ENGINE VALVES

CROSS-REFERENCE TO RELATED APPLICATION

The instant application claims the benefit of Provisional U.S. Patent Application Ser. No. 61/769,171, filed Feb. 25, 2013, the teachings of which are incorporated herein by this reference.

FIELD

The instant disclosure relates generally to internal combustion engines and, in particular, to an apparatus and system for actuating engine valves.

BACKGROUND

Internal combustion engines typically use either a mechanical, electrical, or hydro-mechanical valve actuation system to actuate the engine valves. These systems may include a combination of camshafts, rocker arms and pushrods that are driven by the engine's crankshaft rotation. When a camshaft is used to actuate the engine valves, the timing of the valve actuation may be fixed by the size and location of the lobes on the camshaft.

For each 360 degree rotation of the camshaft, the engine completes a full cycle made up of four strokes (i.e., expansion, exhaust, intake, and compression). Both the intake and exhaust valves may be closed, and remain closed, during most of the expansion stroke wherein the piston is traveling away from the cylinder head (i.e., the volume between the cylinder head and the piston head is increasing). During positive power operation, fuel is burned during the expansion stroke and positive power is delivered by the engine. The expansion stroke ends at the bottom dead center point, at which time the piston reverses direction and the exhaust valve may be opened for a main exhaust event. A lobe on the camshaft may be synchronized to open the exhaust valve for the main exhaust event as the piston travels upward and forces combustion gases out of the cylinder.

Additional auxiliary valve events, while not required, may be desirable and are known to provide flow control of exhaust gas through an internal combustion engine in order to provide vehicle engine braking. For example, it may be desirable to actuate the exhaust valves for compression-release (CR) engine braking, bleeder engine braking, exhaust gas recirculation (EGR), brake gas recirculation (BGR), or other auxiliary valve events. Further still, other positive power valve motions, generally classified as variable valve actuation (VVA) event, such as but not limited to, early intake valve opening (EIVC), late intake valve closing (LIVC), early exhaust valve opening (EEVO) may also be desirable.

During compression-release type engine braking, the exhaust valves may be selectively opened to convert, at least temporarily, a power producing internal combustion engine into a power absorbing air compressor. As a piston travels upward during its compression stroke, the gases that are trapped in the cylinder may be compressed thereby opposing the upward motion of the piston. As the piston approaches the top dead center (TDC) position, at least one exhaust valve may be opened to release the compressed gases from the cylinder to the exhaust manifold, preventing the energy stored in the compressed gases from being returned to the engine on the subsequent expansion down-stroke. In doing so, the engine may develop retarding power to help slow the vehicle down.

During bleeder type engine braking, in addition to, or in place of, the main exhaust valve event, which occurs during the exhaust stroke of the piston, the exhaust valve(s) may be held slightly open during the remaining three engine cycles (full-cycle bleeder brake) or during a portion of the remaining three engine cycles (partial-cycle bleeder brake). The bleeding of cylinder gases in and out of the cylinder may act to retard the engine. Usually, the initial opening of the braking valve(s) (i.e., those valves used to accomplish the braking action) in a bleeder braking operation is in advance of the compression TDC (i.e., early valve actuation) and then lift is held constant for a period of time. As such, a bleeder type engine brake may require lower force to actuate the valve(s) due to early valve actuation, and generate less noise due to continuous bleeding instead of the rapid blow-down of a compression-release type brake.

EGR systems may allow a portion of the exhaust gases to flow back into the engine cylinder during positive power operation, typically resulting in a reduced amount of nitrogen oxides (NOx) created by the engine during positive power operations. An EGR system can also be used to control the pressure and temperature in the exhaust manifold and engine cylinder during engine braking cycles. Internal EGR systems recirculate exhaust gases back into the engine cylinder through an exhaust valve(s) and/or an intake valve(s).

BGR systems may allow a portion of the exhaust gases to flow back into the engine cylinder during engine braking operation. Recirculation of exhaust gases back into the engine cylinder during the intake stroke, for example, may increase the mass of gases in the cylinder that are available for compression-release braking. As a result, BGR may increase the braking effect realized from the braking event.

Conventional engine brakes typically have a dedicated component such as a rocker arm or housing that transfers motion from a dedicated braking cam to the braking valve. For example, the Cummins Engine Co. ISX15L engine brake has a dedicated cam rocker brake where the sole purpose is to transfer braking motions from the braking cam to the braking valve. Unfortunately, such known conventional systems require dedicated components and extra space for installation.

SUMMARY

The instant disclosure describes an apparatus for actuating first and second engine valves associated with a given engine cylinder. In particular, the apparatus may comprise a rocker arm (which may comprise an exhaust or an intake rocker arm) that receives motion from a primary valve actuation motion source at a motion receiving end of the rocker arm. A master piston, residing within a master piston bore formed in the rocker arm at the motion receiving end, is configured to received motion from an auxiliary valve actuation motion source. A slave piston, residing within a slave piston bore formed in the rocker arm at a valve actuation end of the rocker arm, is configured to provide auxiliary valve actuation motion to the first engine valve. A hydraulic circuit is provided in the rocker arm connecting the master piston bore and the slave piston bore, and a check valve is disposed within the rocker arm, configured to supply hydraulic fluid to the hydraulic circuit. In various embodiments, cam rollers/tappets or balls/sockets may be employed to receive the motion from the primary and auxiliary valve action motion sources, which, in these instances, may comprise cams or pushrods, respectively. The master piston bore may be formed in a master piston boss extending laterally from the rocker arm. A primary valve actuator may be provided on the valve actuation end of the rocker arm both the first and second engine valves. In one embodiment, the primary valve actuator is located more distally along the valve actuation end than the slave piston relative to the motion receiving end of the rocker arm. The rocker arm may further comprise a rocker arm shaft bore and an hydraulic fluid supply port positioned on a surface of the rocker arm shaft bore. An hydraulic fluid supply passage can provide fluid communication between the hydraulic fluid supply port and the check valve.

Additionally, the various embodiments of the apparatus may be incorporated into a system, such as an internal combustion engine, comprising the rocker arm shaft, the primary valve actuation motion source and the auxiliary valve actuation motion source. The system may further comprise at least one fluid supply device configured to supply hydraulic fluid to the check valve, which fluid supply device(s) may operate under the direction of a suitable controller.

BRIEF DESCRIPTION OF THE DRAWINGS

The features described in this disclosure are set forth with particularity in the appended claims. These features will become apparent from consideration of the following detailed description, taken in conjunction with the accompanying drawings. One or more embodiments are now described, by way of example only, with reference to the accompanying drawings wherein like reference numerals represent like elements and in which:

DETAILED DESCRIPTION OF THE PRESENT EMBODIMENTS

Figure 1:
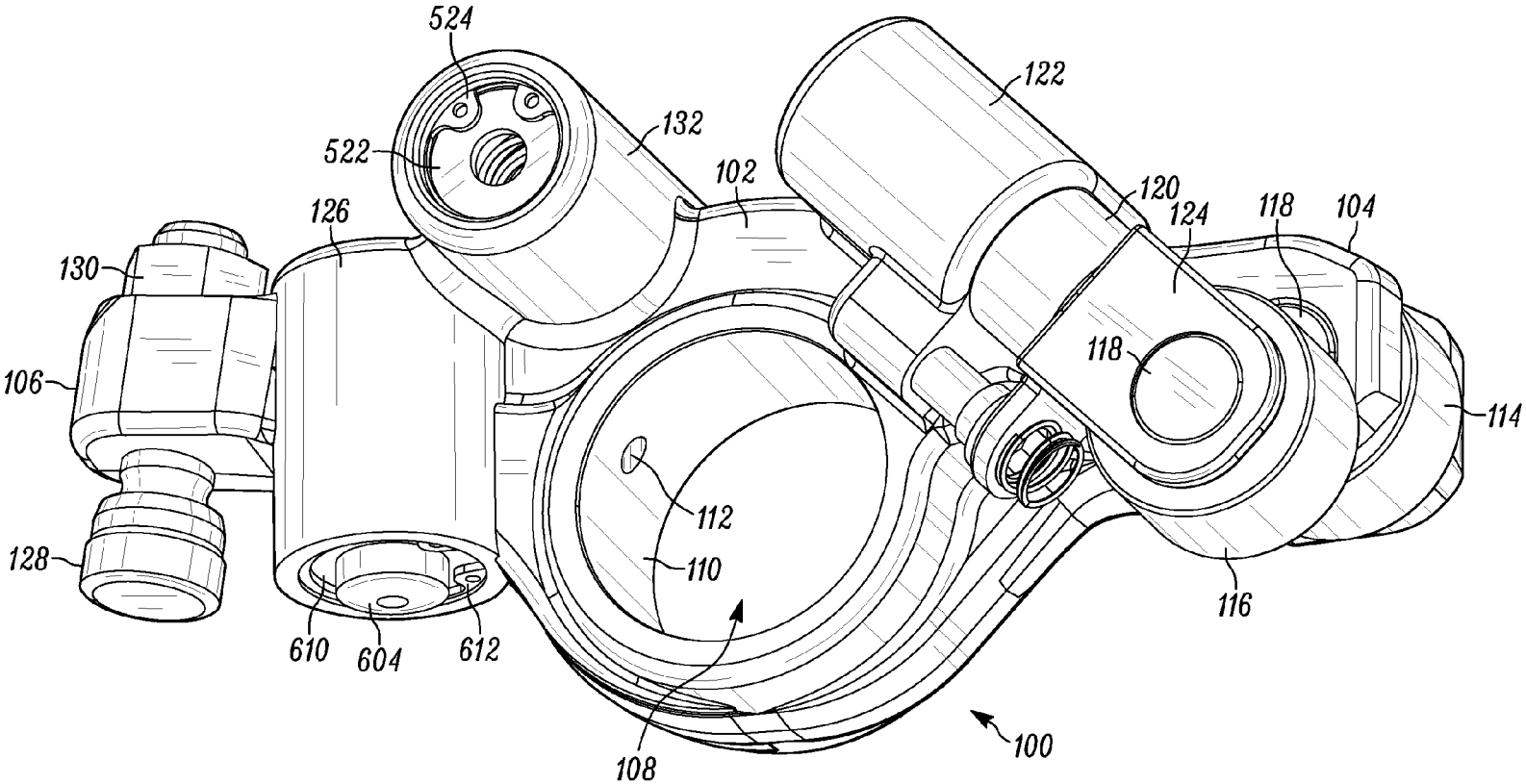
FIG. 1 is a bottom, right, perspective view of an apparatus in accordance with the instant disclosure.
Figure 2:
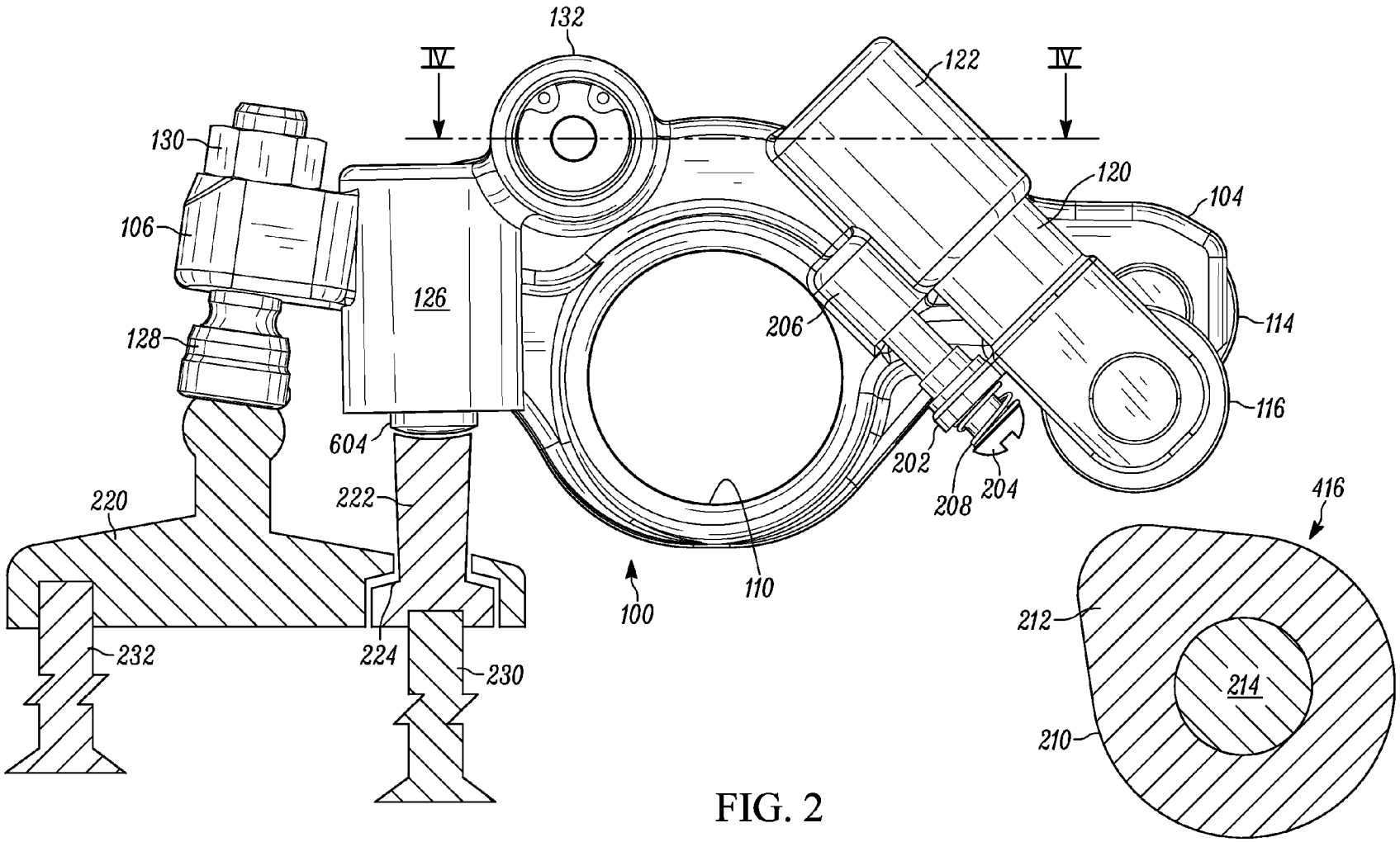
FIG. 2 is a right side view of an apparatus in accordance with the instant disclosure, and further illustrating various components of a system with which the apparatus may be beneficially employed.
Figure 3:
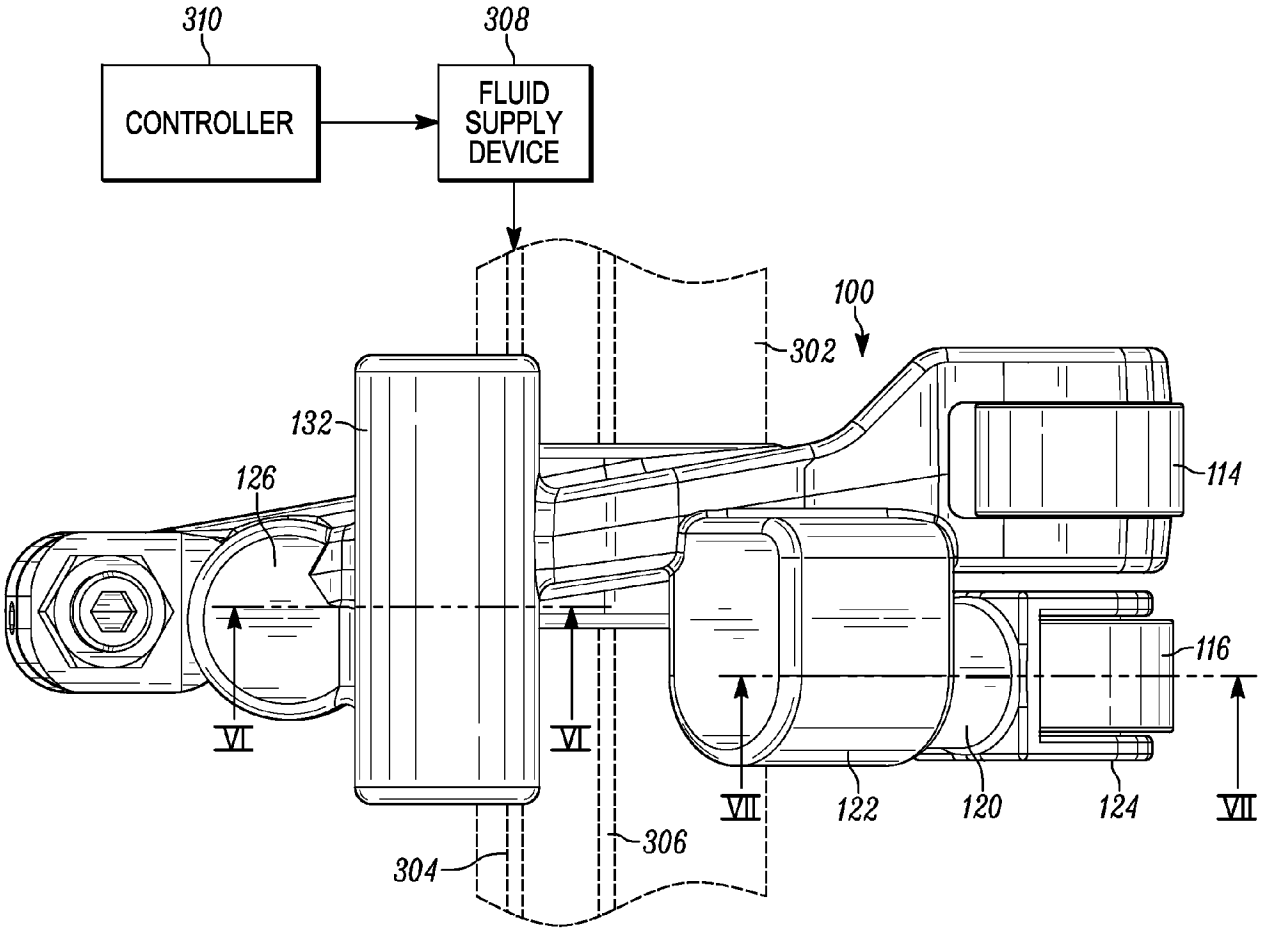
FIG. 3 is a top view of an apparatus in accordance with the instant disclosure, and further illustrating various components of a system with which the apparatus may be beneficially employed.

Referring now to FIGS. 1-3, an exemplary embodiment of an apparatus 100 in accordance with the instant disclosure is illustrated. In particular, the apparatus 100 comprises a rocker arm 102 having a motion receiving end 104 and a valve actuation end 106. The rocker arm 102 may be configured as an exhaust rocker arm or an intake rocker arm as a matter of design choice. The rocker arm 102 has a rocker arm shaft bore 108 formed therein, which bore is defined by a surface 110 and configured to receive a rocker arm shaft 302 (FIG. 3). Dimensions of the rocker arm shaft bore 108 are chosen to permit the rocker arm to rotate about the rocker arm shaft. An hydraulic fluid supply port 112 is formed on the surface 110 and is positioned to received fluid, such as engine oil, provided by a control fluid channel 304 formed in the rocker arm shaft 302.

Figure 4:
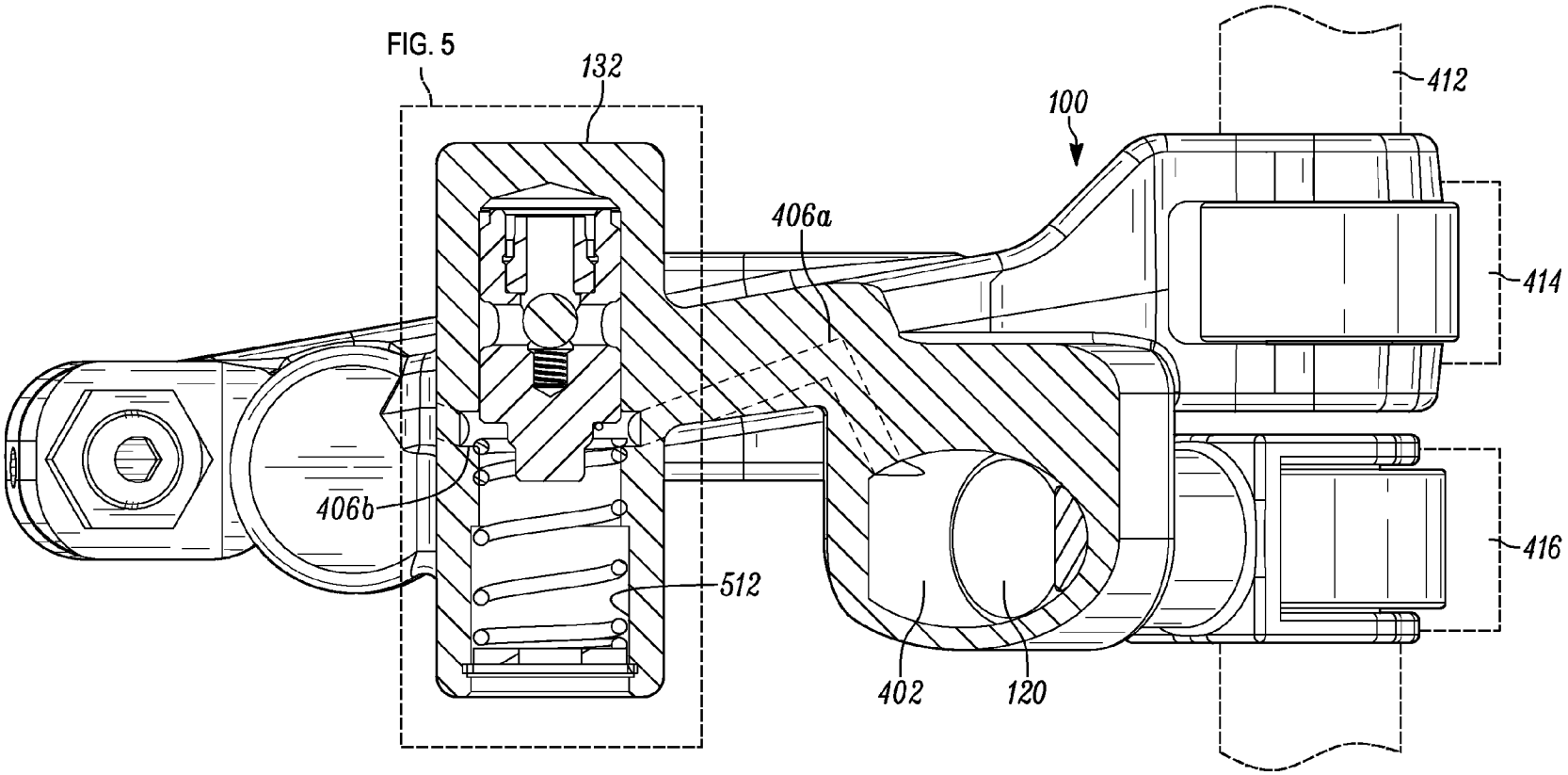
FIG. 4 is a top, partial cross-sectional view of an apparatus in accordance with the instant disclosure, and further illustrating various components of a system with which the apparatus may be beneficially employed.

The motion receiving end 104 of the rocker arm 102 is configured to receive valve actuation motions from both a primary valve actuation motion source 414 and an auxiliary valve actuation motion source 416 (FIG. 4). In the illustrated embodiment, the valve actuation motions are received via a primary cam roller 114 and an auxiliary cam roller 116, as would be the case where the primary and auxiliary valve actuation motion sources 414, 416 comprise cams residing on an overhead camshaft. As shown, the cam rollers 114, 116 may be attached to the rocker arm 102 via cam roller axles 118. However, as will be appreciated by those having ordinary skill in the art, the cam rollers 114, 116 may be replaced, for example, with tappets configured to contact an overhead cam. In another alternative, as in the case where the primary and auxiliary valve actuation motion sources 414, 416 comprise pushrods, the rollers may be replaced by a ball or socket implementation. Further still, it may be desirable for the master piston 120, described below, to directly receive motion from a suitable pushrod, without any intervening tappet.

A feature of the instant disclosure is that the auxiliary valve actuation motion is received directly by a master piston 120 residing within a master piston boss 122 extending laterally from the rocker arm 102. In an embodiment, the master piston boss 122 is configured such that the master piston 120 aligns with the auxiliary valve actuation motion source 416, thereby facilitating the direction transmission of the auxiliary valve actuation motion. As shown, the master piston 120 comprises an end 124 extending out of a master piston bore 402 (FIGS. 4 and 7) configured, in the illustrated example, to support the auxiliary cam roller 116. Once again, the end 124 of the master piston 120 may be configured to receive the auxiliary valve actuation motion based on the particular implementation of the auxiliary valve actuation motion source 416. As best illustrated in FIG. 2, the master piston 120 may comprise a flange 202 having an opening to receive a master piston travel limit screw 204. In turn, the master piston travel limit screw 204 may be mounted in a limit screw boss 206 extending, in the illustrated embodiment, below the master piston boss 122. A master piston bias spring 208 is provided to bias the master piston into the master piston bore 402 when the hydraulic circuit (more fully described below) is not charged, thereby preventing the master piston 120 from receiving any motion from the auxiliary valve actuation motion source 416. As those having ordinary skill in the art will appreciate, a variety of configurations may be employed whereby the bias spring 208 is permitted to bias the master piston 120 into the master piston bore 402, without loss of generality. Additionally, master piston travel limit screw 204 serves to align, in the illustrated example, the auxiliary cam roller 116 with the camshaft. However, it is understood that the travel limiting function of the master piston travel limit screw 204 may be optional if the auxiliary camshaft is designed to follow the main event to prevent over extension of the master piston 120.

Figure 5:
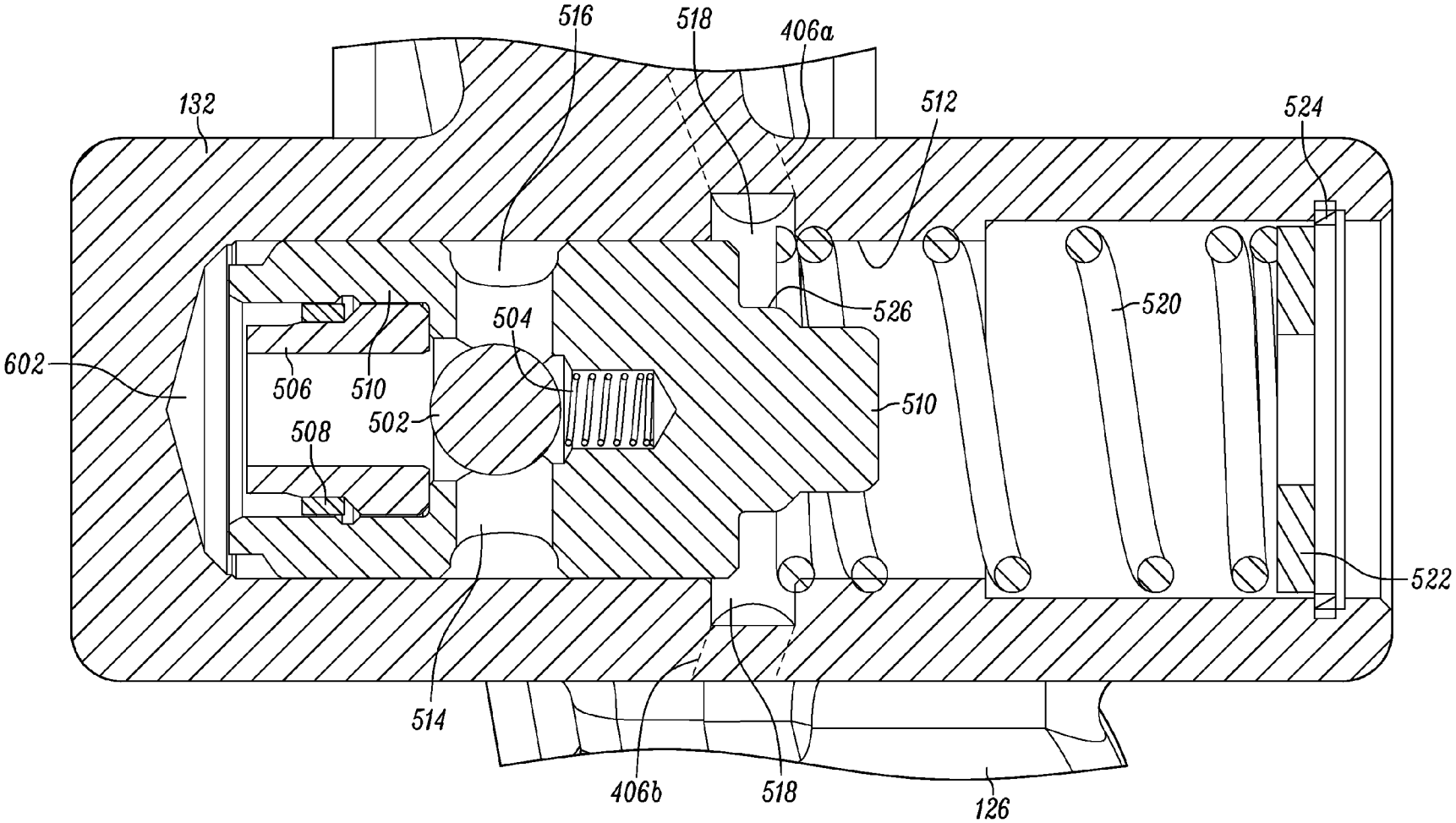
FIG. 5 is a magnified, top, partial cross-section view of the apparatus illustrated in FIG. 4, particularly illustrating features of a check valve and control valve.
Figure 6:
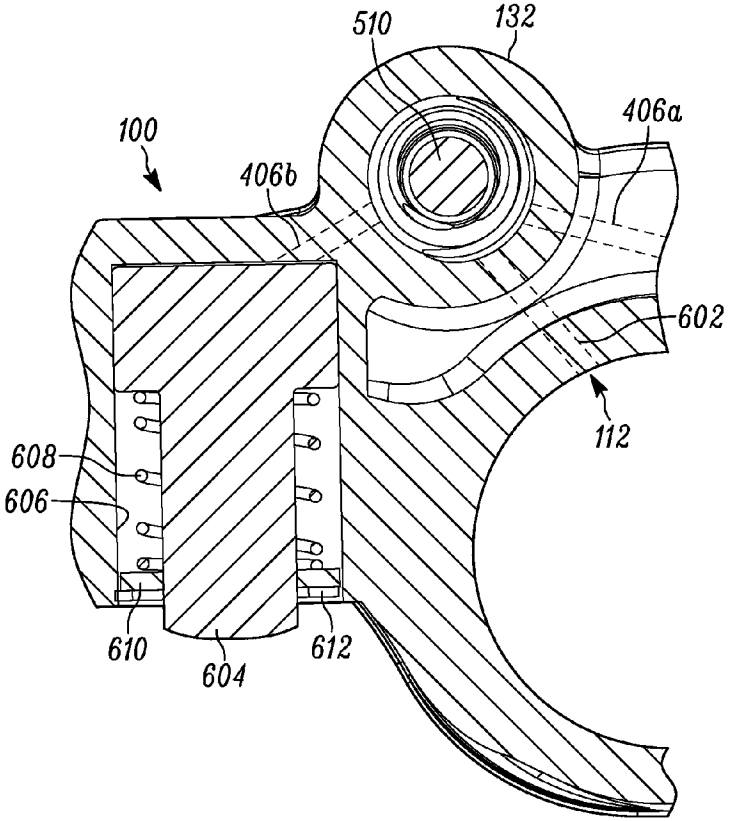
FIG. 6 is a right, partial cross-sectional view of an apparatus in accordance with the instant disclosure, particularly illustrating features of a slave piston assembly.

As further illustrated in FIGS. 1-6, the rocker arm 102 may comprise a slave piston housing 126 disposed at the valve actuation end 106 of the rocker arm 102. The slave piston housing 126 has a slave piston bore 606 defined therein that, in turn, receives a slave piston 604 (FIG. 6). As best shown in FIG. 2, the slave piston housing 126 is configured such that the slave piston 604 may directly contact a bridge pin 222 residing in a valve bridge 220, thereby permitting the slave piston 604 to actuate a first engine valve 230 independently of a second engine valve 232. As further shown in FIG. 2, a small amount of lash (e.g., less than 1 mm) may be provided between the slave piston 604 and the bridge pin 222.

A primary valve actuator 128 is also disposed at the valve actuation end 106 of the rocker arm 102. In the illustrated embodiment, the primary valve actuator 128 comprises a so-called "elephant's foot" (efoot) screw assembly including a lash adjustment nut 130. Those having ordinary skill in the art will appreciate that the primary valve actuator 128 may be implemented using other, well-known mechanisms for coupling valve actuation motions to one or more engine valves. As further illustrated, the primary valve actuator 128 is located more distally along the rocker arm's valve actuation end 106 than the slave piston housing 126 and, consequently, the slave piston 604, relative to the motion receiving end 104 of the rocker arm 102. However, this is not a requirement as the primary valve actuator 128 may be equidistant from the motion receiving end 104 as the slave piston 604, or even less distant from the motion receiving end 104 than the slave piston 604.

Further still, a control valve housing 132 is provided in the rocker arm. As best shown in FIGS. 1 and 3, the control valve housing 132 may be transversely aligned relative to a longitudinal axis of the rocker arm 102, though this is not a requirement. As described in greater detail below, the control valve housing 132, in the illustrated embodiment, encloses a check valve used to regulate the flow of hydraulic fluid into an hydraulic circuit in fluid communication with the master piston bore and the slave piston bore.

FIG. 2, in addition to illustrating the apparatus 100, also illustrates other engine components that, in combination with the apparatus 100, may form a system for controlling actuation of the engine valves 230, 232. In particular, FIG. 2 illustrates the auxiliary valve actuation motion source 416 implemented as a cam 210 mounted on a camshaft 214. Although not illustrated in FIG. 2, in this embodiment, the primary valve actuation motion source 414 would also comprise a cam mounted on a camshaft. As shown, such a cam 210 may comprise one or more lobes 212 (only one shown for ease of illustration) extending from the base circle of the cam 210. As known in the art, the lobes 212 may be sized, shaped and positioned to instigate any of a number of valve movements designed to achieve desired functions, e.g., main exhaust events, compression release braking, bleeder braking, EGR, BGR or other valve events such as the VVA motions noted above. It is further noted that, in the illustrated embodiment, the master piston 120 is shown in a retracted position, i.e., the bias spring 208 is biasing the master piston 120 into the master piston bore 402, thereby preventing any motion transfer between the cam 210 and the master piston 120. Those having skill in the art will appreciate, however, that rather than biasing the master piston 120 inward to prevent motion transfer, it is also possible to bias the master piston 120 outward and into continuous contact with the 210. In this instance, the motion imparted by the cam 210 on the master piston 120 will always be lost except in those instances in which the hydraulic circuit 406 is fully charged, as described in greater detail below.

As further shown in FIG. 2, the primary valve actuator 128 is illustrated engaging a valve bridge 220. As known in the art, the valve bridge 220 permits valve actuation motion provided by the rocker arm 102 (particularly, those valve actuation motions received via the primary valve actuation motion source 414) to be transmitted to both the first and second engine valves 230, 232. As described above, the valve bridge 220 may comprise a bridge pin 22 that permits actuation of the first engine valve 230 by virtue of actuation motions applied to the valve bridge 220 (which then engages shoulders 224 of the bridge pin 222) or directly to the bridge pin 222, thereby permitting independent control of the first engine valve 230. As will be appreciated by those having ordinary skill in the art, it is understood that the engine valves 230, 232 may comprise intake or exhaust valves, and that the engine valve independently actuated by the slave piston 604 may comprise an inboard valve (such as the first engine valve 230, as shown) or an outboard valve (such as the second engine valve 232).

Referring now to FIG. 3, additional engine components are shown that, in combination with the apparatus 100, may form a system for controlling actuation of the engine valves 230, 232. More particularly, the apparatus 100 is shown mounted on an rocker arm shaft 302. The rocker arm shaft may include a control fluid channel 304 formed therein, as well as a lubrication fluid channel 306. As known in the art, the lubrication fluid channel 306 is coupled to various outlet ports in the rocker arm shaft 302 permitting a suitable lubricant, such as engine oil, to be distributed to the rocker arm 102 and related components. In a similar manner, the control fluid channel 304 provides a hydraulic fluid, such as engine oil, to an hydraulic circuit 406 within the rocker arm 102 (via the hydraulic fluid supply port 112) as described in further detail below. As shown, fluid in the control fluid channel 304 may be regulated by one or more fluid supply devices 308 that are, in turn, controlled by a controller 310.

For example, the fluid supply device(s) 308 may comprise a suitable solenoid, as known in the art, that selectively permits the flow of pressurized fluid (typically, around 50 psig) into the control fluid channel 304. The controller 310 may comprise a processing device such as a microprocessor, microcontroller, digital signal processor, co-processor or the like or combinations thereof capable of executing stored instructions, or programmable logic arrays or the like, as embodied, for example, in an engine control unit (ECU). As known in the art, the controller 310 may provide suitable electrical signals to the fluid supply device(s) 308 to selectively permit or restrict the flow of fluid into the control fluid channel 304. For example, in one embodiment, the controller 310 may be coupled to a user input device (e.g., a switch, not shown) through which a user may be permitted to activate a desired auxiliary valve motion mode of operation. Detection by the controller 310 of selection of the user input device may then cause the controller 310 to provide the necessary signals to the fluid supply device(s) 308 to permit the flow of fluid in the control fluid channel 304. Alternatively, or additionally, the controller 310 may be coupled to one or more sensors (not shown) that provide data used by the controller 310 to determine how to control the fluid supply device(s) 308.

Additionally, it is understood that regulation of the fluid in the control fluid channel 304 may be provided on a global or local level. That is, in the case of global control, a single fluid supply device 308 may be provided which controls the supply of fluid to a single control fluid channel 304 that, in turn, supplies the hydraulic fluid to a plurality of rocker arms associated with a plurality of engine cylinders. Alternatively, in the case of local control, one of a plurality of fluid supply devices 308, each associated with a different cylinder, may control flow of fluid into the control fluid channel 304 that, in turn, supplies the hydraulic fluid to only that rocker arm corresponding to the associated cylinder. While the global approach is less complex to implement, the local approach permits greater selectivity and control over the operation of individual engine cylinders. Further still, an intermediate approach could be employed whereby multiple fluid supply devices 308 are deployed, but each associated with and controlling fluid flow for a group of cylinders, rather than individual cylinders.

Figure 7:
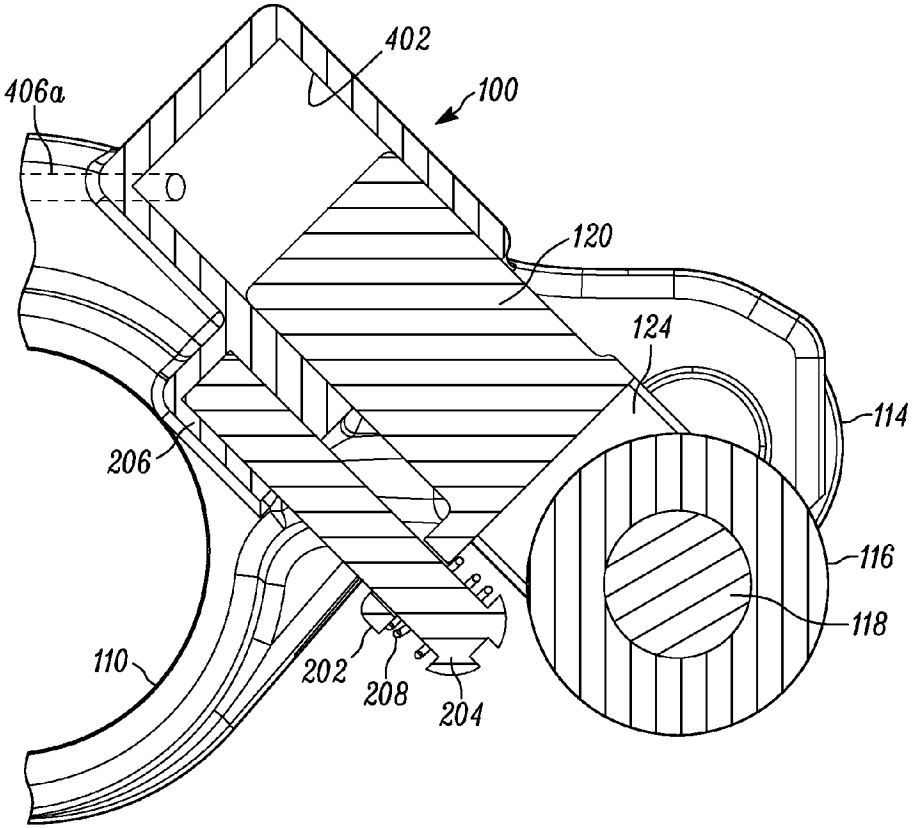
FIG. 7 is a right, partial cross-sectional view of an apparatus in accordance with the instant disclosure, particularly illustrating features of a master piston assembly.

Referring now to FIGS. 4-7, the internal hydraulic features of the apparatus 100 are further illustrated. For clarity, it is noted that FIGS. 4 and 5 respectively illustrate a top, partial cross-section, taken along the section plane IV-IV shown in FIG. 2, and a magnified, top, partial cross-section view of the control housing 132 and related components. FIGS. 6 and 7 respectively illustrate partial right side cross-sectional views taken along section planes VI-VI and VII-VII, respectively, shown in FIG. 3. As best shown in FIG. 6, an hydraulic fluid supply passage 602 is provided in the rocker arm 102 between the hydraulic fluid supply port 112 and the control valve housing 132. Though not shown, the hydraulic fluid supply port 112 aligns with a fluid outlet in the rocker arm shaft that, in turn, is in fluid communication with the control fluid channel 304. As described in greater detail below, a check valve within the control valve housing 132 controls the supply of hydraulic fluid (when present), received from the hydraulic fluid supply passage 602, to an hydraulic circuit 406. In the illustrated embodiment, the hydraulic circuit 406 comprises a first leg 406*a* providing fluid communication between the control valve housing 132 and the master piston bore 402, and a second leg 406*b* providing fluid communication between the control valve housing 132 and the slave piston bore 606.

FIG. 6 further illustrates the slave piston 604 residing within the slave piston bore 606. Also shown is a slave piston spring 608 that biases the slave piston 604 into the slave piston bore 606. A washer 610 and retaining ring 612 are also provided to retain the slave piston spring 608 in the slave piston bore 606, and to permit the slave piston 604 to extend out of the bore 606 when the hydraulic circuit 406 is charged, as described in greater detail below. In an embodiment, a small amount of lash (e.g., less than 1 mm) may be provided between the slave piston 604 and the bridge pin 222 (see FIG. 2). In an embodiment, the slave piston spring 608 is selected such that charging of the hydraulic circuit 406 with relatively low pressure hydraulic fluid (as provided, for example, from a common oil supply) will not, by itself, cause the slave piston 604 to extend out of the slave piston bore 606 and thereby take up the provided lash. Once the hydraulic circuit 406 is fully charged with hydraulic fluid, only the comparatively high pressures presented by the master piston 120 to the slave piston 604 via the hydraulic circuit 406 will be sufficient to overcome the bias presented by the slave piston spring 608, and thereby take up any provided lash.

As noted previously, a check valve is provided to supply hydraulic fluid into the hydraulic circuit 406. A particular embodiment of this is illustrated in FIG. 5 in which a check valve, illustrated by a check valve ball 502 and check valve spring 504, is shown. The check valve ball 502 is biased by the check valve spring 504 into contact with a check valve seat 506 that is, in turn, secured with a retaining ring 508. As further shown, the check valve is in fluid communication with the hydraulic fluid supply passage 602. In the illustrated embodiment, the check valve resides within a control valve piston 510 that, in turn, is disposed within a control valve bore 512 formed in the control valve housing 132. As further shown, a control valve spring 520 is also disposed within the control valve bore 512, thereby biasing the control valve piston 510 into a resting position (i.e., toward the left in FIG. 5). A washer 522 and retaining ring 424 may be provided to retain the control valve spring 520 within the control valve bore 512 and, as described below, to provide a pathway for hydraulic fluid to escape the control valve housing 132.

When present, the hydraulic fluid is sufficiently pressurized to overcome the bias of the check valve spring 504 causing the check valve ball 502 to displace from the seat 506, thereby permitting hydraulic fluid to flow into a transverse bore 514 formed in the control valve piston 510 and then into a first circumferential, annular channel 516 also formed in the control valve piston 510. Simultaneously, the presence of the hydraulic fluid in the hydraulic fluid supply passage 602 causes the control valve piston 510 to overcome the bias provided by the control valve spring 520, thereby permitting the control valve piston 510 to displace (toward the right in FIG. 5) until the first annular channel 516 substantially aligns with a second, circumferential annular channel 518 formed in the interior wall defining the control valve bore 512. Once the first and second annular channels 516, 518 are aligned, the hydraulic fluid is free to flow into, and thereby charge, the hydraulic circuit 406, which, as shown, is in fluid communication with the second annular channel 518. As best shown in FIGS. 6 and 7, charging of the hydraulic circuit 406 with the hydraulic fluid will cause hydraulic fluid to flow into the slave piston bore 606 and the master piston bore 402, thereby causing master piston 120 to extend out of its bore. Once the hydraulic circuit has been filled, the pressure gradient across the check valve ball 502 will equalize, thereby permitting the check valve ball 502 to re-seat and substantially preventing the escape of the hydraulic fluid from the hydraulic circuit 406. Given the relative non-compressibility of the hydraulic fluid, the charged hydraulic circuit 406, in combination with the now-filled slave and master piston bores 606, 402, essentially forms a rigid connection between the master piston 120 and the slave piston 604 such that motion applied to the master piston 120 (as provided, for example, by the auxiliary valve actuation motion source 416) is transferred to the slave piston 604.

When the supply of pressurized hydraulic fluid is removed from the hydraulic fluid supply passage 602, the decrease in pressure presented to the control valve piston 510 allows the control valve spring 520 to once again bias the control valve piston 510 back to its resting position. In turn, this causes a reduced-diameter portion 526 of the control valve piston 510 to align with the second annular channel 518, thereby permitting the hydraulic fluid within the hydraulic circuit 406 to be released. In particular, the bias provided on the slave piston 604 and master piston 120 by the respective slave piston bias spring 608 and master piston bias spring 208 will be sufficient to cause at least a portion of the now-depressurized hydraulic fluid to be expelled from their respective bores 606, 402 and, consequently, the hydraulic circuit 406. Because the master and slave pistons 120, 604 will then be retracted into their respective bores 402, 606, no motion will be received from the auxiliary valve actuation motion source 416 or transferred to the first engine valve 230.

While a check valve is used to keep the hydraulic circuit 406, when charged, sufficiently pressurized, it is noted that the particular implementation of the control valve illustrated in FIG. 5 is not a requirement to permit the discharge of the hydraulic fluid. That is, rather than rely on operation of a control valve to permit the release of the hydraulic fluid, it may be possible to permit sufficient leakage elsewhere in the hydraulic circuit 406 and/or piston bores 402, 606 to permit the more gradual leak down of hydraulic fluid, thereby reducing complexity. However, such gradual leakage extends the transition period between the discontinuation of auxiliary valve events and the resumption of a positive power mode. As yet another alternative, a balance between complexity and transition time may be achieved by permitting the venting of hydraulic fluid during a main event motion, thereby shortening the noted transition time without the added complexity of a control valve. Additionally, while a single control valve spring 520 is illustrated in FIG. 5, those having ordinary skill in the art will appreciate that one or more additional springs may be provided to prevent over-translation of the control valve piston 510 past the second annular channel 518. Although a hard stop could be provided within the control valve bore 512 for this purpose, the presence of a secondary control valve spring may also provide the additional benefit of damping pressure spikes that may occur.

Figure 8:
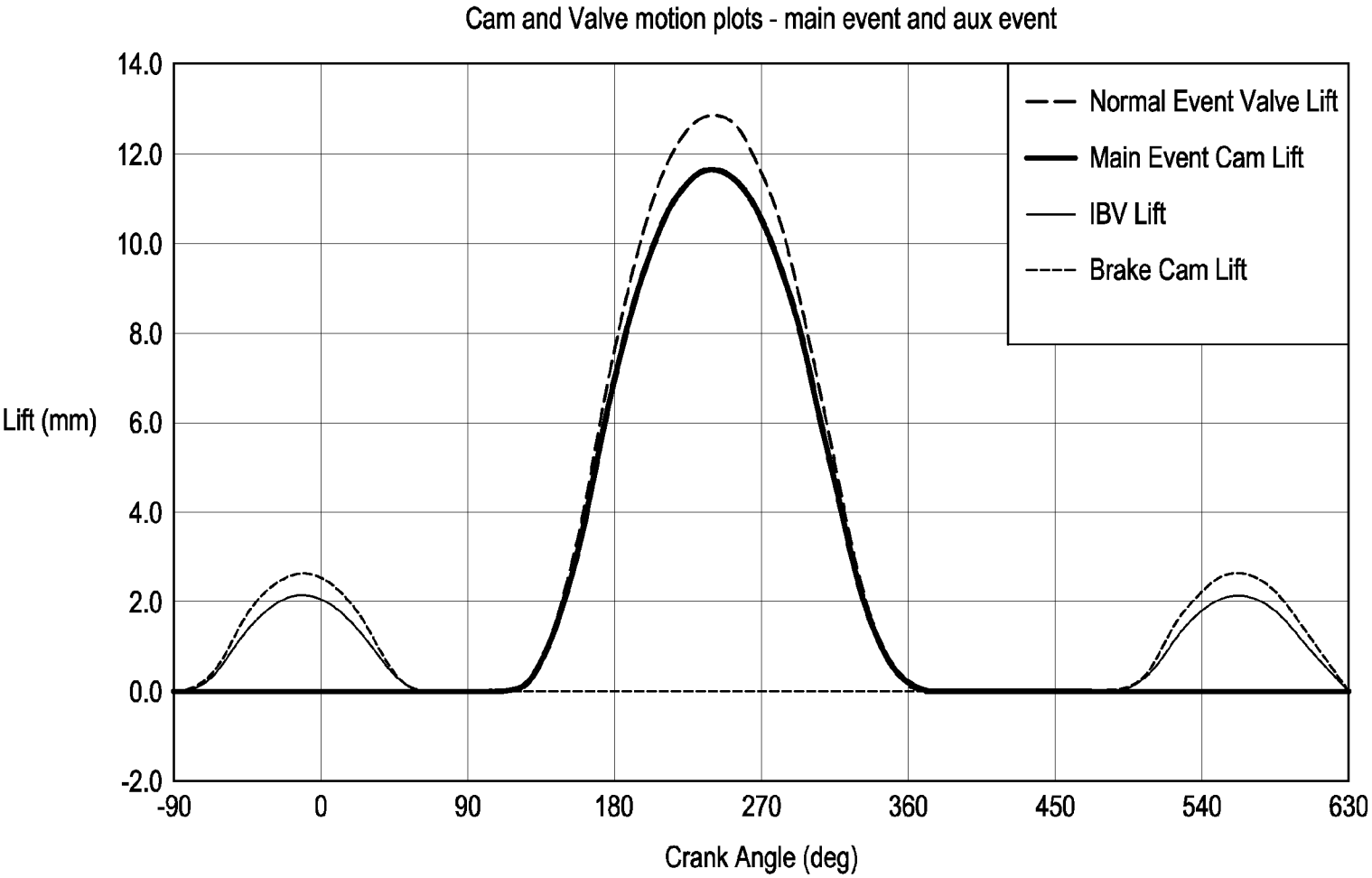
FIGS. 8 and 9 illustrate various cam designs and valve movements for exemplary valve event operations in accordance with various embodiments of the instant disclosure.

FIG. 8 is a graphical representation of exemplary exhaust valve motions and cam design for use in CR engine braking and illustrating how CR and BGR events can be accomplished through the auxiliary valve actuation motion source 416 while still permitting main event exhaust motions through the primary valve actuation motion source 414. That is, as shown in FIG. 8, the main exhaust event (large central curves) reflects the primary cam lift profile as transferred through the primary cam roller 114, whereas the CR and BGR events (smaller curves on either side of the large central curves) reflect the auxiliary cam lift profile as transferred through the auxiliary cam roller 116.

Figure 9:
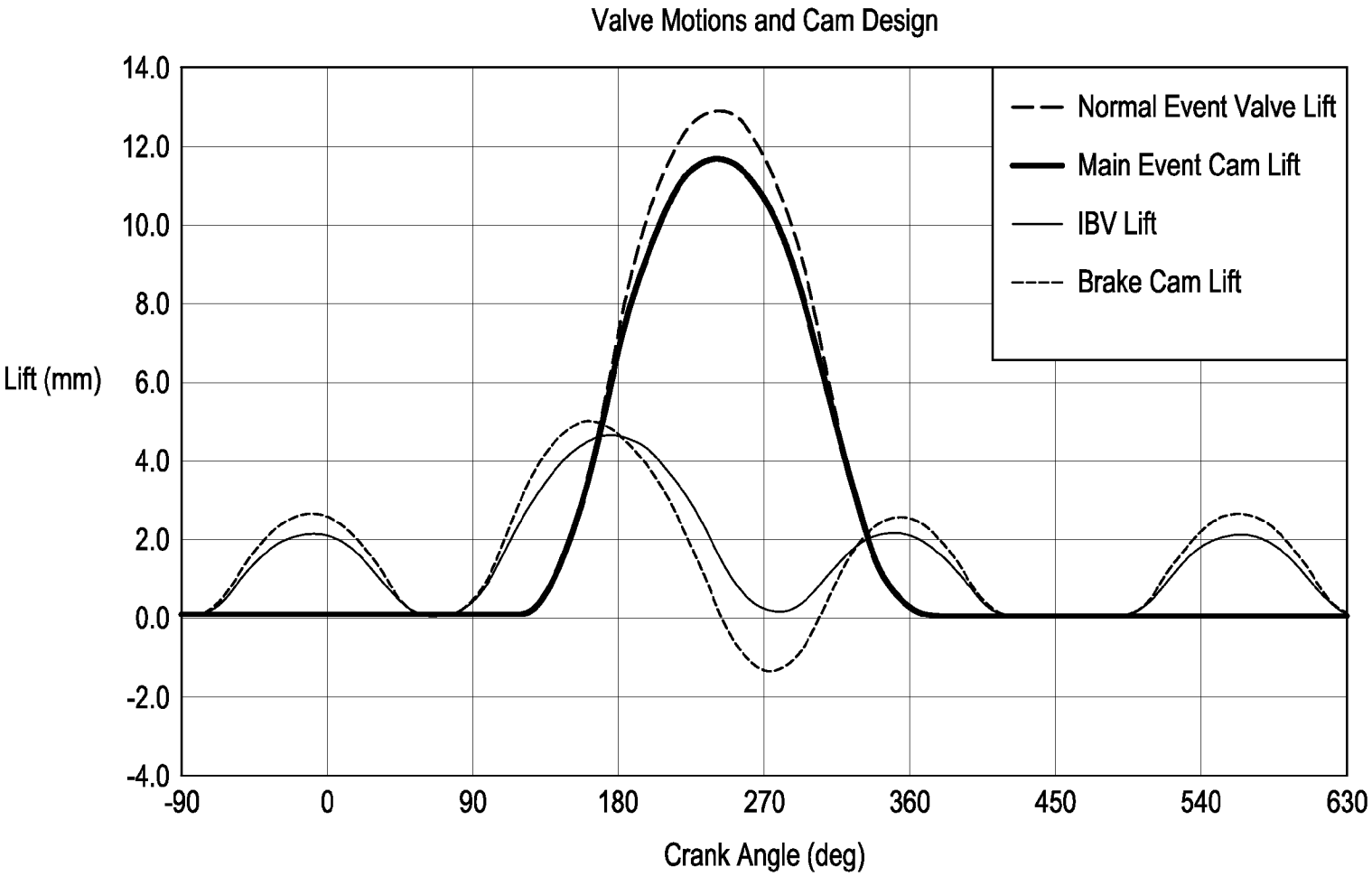

In an embodiment, normal exhaust and intake rocker arms could be replaced by the apparatus 100 disclosed herein. Such an embodiment may be beneficial in a so-called high power density (HPD) implementation, where additional braking power is desired. In this case, a master/slave/hydraulic circuit, as described above, is integrated not only into an exhaust rocker arm, but also an intake rocker arm. In this case, it is presumed that both the exhaust and intake rocker arms each have their own primary and auxiliary valve actuation motion sources, as described above. Accordingly, as in the case where the motion sources are implemented as cams, two braking cam lobes are provided on the motion receiving end of each rocker arm. In this case, the intake and exhaust rocker arms are jointly mounted on a common rocker shaft. Assuming such an implementation, FIG. 9 is a graphical representation of the valve and cam motions, similar to FIG. 8, during operation of an exemplary HPD system. As shown in FIG. 9, this implementation provides not only the main exhaust event (large central curves) and first CR/BGR events (smaller curves at either end of the illustrated graph), but also second CR/BGR events (smaller curves overlapping with the main event curves).

As described above, an improved engine braking apparatus and system is described herein, thereby permitting the disadvantages and problems of currently available devices to be overcome. This is achieved through the provision of integrated master and slave pistons, as well as an hydraulic circuit in a single rocker arm to eliminate the need for a dedicated component, such as a rocker, to provide the necessary valve motions. A particular advantage of such a configuration is the reduction of the number of components and easier packaging in engine configurations where space for dedicated components is not available. For at least these reasons, the above-described techniques represent an advancement over prior art teachings.

While particular preferred embodiments have been shown and described, those skilled in the art will appreciate that changes and modifications may be made without departing from the instant teachings. It is therefore contemplated that any and all modifications, variations or equivalents of the above-described teachings fall within the scope of the basic underlying principles disclosed above and claimed herein.

What is claimed is:

1. An apparatus for actuating first and second engine valves associated with an engine cylinder, comprising:

a rocker arm configured to be disposed on a rocker arm shaft and to actuate the first and second engine valves, and further configured at a motion receiving end of the rocker arm to receive motion from a primary valve actuation motion source;

a master piston disposed in a master piston bore at a portion of the motion receiving end of the rocker arm separate from that portion of the motion receiving end of the rocker arm configured to receive motion from the primary valve actuation motion source and configured, at an end of the master piston extending out of the master piston bore, to receive motion from an auxiliary valve actuation motion source;

a slave piston disposed in a slave piston bore at a valve actuation end of the rocker arm opposite the motion receiving end of the rocker arm, the slave piston configured to provide auxiliary valve actuation motion to only the first of the first and second engine valves;

an hydraulic circuit within the rocker arm; and a check valve disposed in the rocker arm and configured to supply hydraulic fluid to the hydraulic circuit, wherein the hydraulic circuit connects the master piston bore and the slave piston bore.

2. The apparatus of claim 1, the rocker arm further comprising, at the motion receiving end of the rocker arm, a cam roller configured to receive motion from the primary valve actuation motion source.

3. The apparatus of claim 1, the rocker arm further comprising, at the motion receiving end of the rocker arm, a flat tappet configured to receive motion from the primary valve actuation motion source.

4. The apparatus of claim 1, the master piston comprising, at the end of the master piston extending out of the master piston bore, a cam roller configured to receive motion from the auxiliary valve actuation motion source.

5. The apparatus of claim 1, the master piston comprising, at the end of the master piston extending out of the master piston bore, a flat tappet configured to receive motion from the auxiliary valve actuation motion source.

6. The apparatus of claim 1, wherein the master piston bore is formed in a master piston boss extending laterally from the rocker arm.

7. The apparatus of claim 1, the rocker arm further comprising a primary valve actuator at the valve actuation end of the rocker arm.

8. The apparatus of claim 7, wherein the primary valve actuator is located more distally than the slave piston relative to the motion receiving end of the rocker arm.

9. The apparatus of claim 1, wherein the check valve is disposed within a control valve, the control valve disposed within a control valve bore of the rocker arm, and wherein the hydraulic circuit connects the master piston bore, the slave piston bore and the control valve bore.

10. The apparatus of claim 1, the rocker arm comprising a rocker arm shaft bore configured to receive the rocker arm shaft, the rocker arm further comprising an hydraulic fluid supply passage providing fluid communication between the check valve and an hydraulic fluid supply port positioned on a surface of the rocker arm shaft bore.

11. The apparatus of claim 1, wherein the rocker arm is an exhaust rocker arm.

12. The apparatus of claim 1, wherein the rocker arm is an intake rocker arm.

13. A system for actuating first and second engine valves associated with an engine cylinder, comprising:

a rocker arm shaft;

a primary valve actuation motion source;

an auxiliary valve actuation motion source;

a rocker arm disposed on the rocker arm shaft, configured to actuate the first and second engine valves and further configured, at a motion receiving end of the rocker arm, to receive motion from the primary valve actuation motion source;

a master piston disposed in a master piston bore at a portion of the motion receiving end of the rocker arm separate from that portion of the motion receiving end of the rocker arm configured to receive motion from the primary valve actuation motion source and configured, at an end of the master piston extending out of the master piston bore, to receive motion from the auxiliary valve actuation motion source;

a slave piston disposed in a slave piston bore at a valve actuation end of the rocker arm opposite the motion receiving end of the rocker arm, the slave piston configured to provide auxiliary valve actuation motion to only the first of the first and second engine valves;

an hydraulic circuit within the rocker arm; and a check valve disposed in the rocker arm and configured to supply hydraulic fluid to the hydraulic circuit, wherein the hydraulic circuit connects the master piston bore and the slave piston bore.

14. The system of claim 13, wherein the primary valve actuation motion source and the secondary valve actuation motion source comprise cams, the rocker arm further comprising, at the motion receiving end of the rocker arm, a primary cam roller configured to receive motion from the primary valve actuation motion source, and the master piston comprising, at the end of the master piston extending out of the master piston bore, an auxiliary cam roller configured to receive motion from the auxiliary valve actuation motion source.

15. The system of claim 13, wherein the primary valve actuation motion source and the secondary valve actuation motion source comprise pushrods, the rocker arm further comprising, at the motion receiving end of the rocker arm, a primary ball or socket configured to receive motion from the primary valve actuation motion source, and the master piston comprising, at the end of the master piston extending out of the master piston bore, an auxiliary ball or socket configured to receive motion from the auxiliary valve actuation motion source.

16. The system of claim 13, further comprising:

at least one fluid supply device configured to control supply of the hydraulic fluid to the check valve.

17. The system of claim 13, wherein the master piston bore is formed in a master piston boss extending laterally from the rocker arm.

18. The system of claim 13, the rocker arm further comprising a primary valve actuator at the valve actuation end of the rocker arm.

19. The system of claim 18, wherein the primary valve actuator is located more distally than the slave piston relative to the motion receiving end of the rocker arm.

20. The system of claim 13, wherein the check valve is disposed within a control valve, the control valve disposed within a control valve bore of the rocker arm, and wherein the hydraulic circuit connects the master piston bore, the slave piston bore and the control valve bore.

21. The system of claim 13, the rocker arm comprising a rocker arm shaft bore configured to receive the rocker arm shaft, the rocker arm further comprising an hydraulic fluid supply passage providing fluid communication between the check valve and an hydraulic fluid supply port positioned on a surface of the rocker arm shaft bore.

22. The system of claim 13, wherein the rocker arm is an exhaust rocker arm.

23. The system of claim 13, wherein the rocker arm is an intake rocker arm.

* * * * *